US012480498B2

(12) United States Patent
Howell et al.

(10) Patent No.: US 12,480,498 B2
(45) Date of Patent: Nov. 25, 2025

(54) ELECTRICAL SUBMERSIBLE PUMP WITH SINGLE DIRECTION LUBRICANT FLOW

(71) Applicant: Baker Hughes Oilfield Operations LLC, Houston, TX (US)

(72) Inventors: Steven Alan Howell, Oklahoma City, OK (US); David Tanner, Broken Arrow, OK (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 189 days.

(21) Appl. No.: 18/484,650

(22) Filed: Oct. 11, 2023

(65) Prior Publication Data

US 2024/0125219 A1 Apr. 18, 2024

Related U.S. Application Data

(60) Provisional application No. 63/415,625, filed on Oct. 12, 2022.

(51) Int. Cl.
*F04D 13/10* (2006.01)
*F04D 1/04* (2006.01)
(Continued)

(52) U.S. Cl.
CPC ..... *F04D 13/10* (2013.01); *F04D 1/04* (2013.01); *F04D 13/12* (2013.01); *F04D 29/0413* (2013.01); *F04D 29/061* (2013.01); *F04D 29/183* (2013.01); *F04D 29/2255* (2013.01); *F04D 29/2283* (2013.01); *F04D 29/245* (2013.01); *E21B 43/128* (2013.01)

(58) Field of Classification Search
CPC . F04D 1/04; F04D 13/10; F04D 13/12; F04D 20/0413; F04D 20/061; F04D 20/183; F04D 20/2255; F04D 20/2283; F04D 20/245; E21B 43/128
USPC ..... 417/315
See application file for complete search history.

(56) References Cited

U.S. PATENT DOCUMENTS 3,796,523 A * 3/1974 Albrecht ..... F04C 14/04 418/32
4,824,332 A * 4/1989 Perkins ..... B60S 1/481 417/442

(Continued)

FOREIGN PATENT DOCUMENTS

DE 19702413 A1 * 11/1997 ..... F04D 29/183
JP 2004-360614 A * 12/2004

OTHER PUBLICATIONS

International Search Report and Written Opinion for PCT Application No. PCT/US2023/076718 dated Feb. 8, 2024.

*Primary Examiner* — Charles G Freay
(74) *Attorney, Agent, or Firm* — Baker Hughes Company

(57) ABSTRACT

An electrical submersible pumping system ("ESP") for use in a wellbore includes an electrical motor, a pump, a shaft coupled between the motor and pump, and a lubricant pump for circulating lubricant within the ESP. The lubricant pump includes a diffuser and an impeller that mounts onto and rotates with shaft rotation. A portion of the impeller has a frusto-conical outer surface, which is circumscribed by a portion of the diffuser profiled complementary to the frusto-conical portion of the impeller. The pump directs lubricant flow in a single direction irrespective of the rotational direction of the shaft.

18 Claims, 3 Drawing Sheets

(51) Int. Cl.

| | |
|---|---|
| ***F04D 13/12*** | (2006.01) |
| ***F04D 29/041*** | (2006.01) |
| ***F04D 29/06*** | (2006.01) |
| ***F04D 29/18*** | (2006.01) |
| ***F04D 29/22*** | (2006.01) |
| ***F04D 29/24*** | (2006.01) |
| *E21B 43/12* | (2006.01) |

(56) References Cited

U.S. PATENT DOCUMENTS

| | | | | |
|---|---|---|---|---|
| 5,540,550 | A * | 7/1996 | Kubota | F04D 29/2277 416/179 |
| 2013/0341033 | A1 | 12/2013 | Carstensen et al. | |
| 2015/0023815 | A1 * | 1/2015 | Tetzlaff | F04D 1/04 417/365 |
| 2017/0037861 | A1 | 2/2017 | Rutter et al. | |
| 2018/0313359 | A1 | 11/2018 | Meyer | |
| 2019/0186245 | A1 | 6/2019 | Bellmyer et al. | |
| 2021/0293124 | A1 | 9/2021 | Biddick et al. | |

* cited by examiner

ELECTRICAL SUBMERSIBLE PUMP WITH SINGLE DIRECTION LUBRICANT FLOW

CROSS-REFERENCE TO RELATED APPLICATION

This application is a continuation in part of and claims priority to and the benefit of U.S. Provisional Application Ser. No. 63/415,625, filed Oct. 12, 2022, the full disclosure of which is incorporated by reference herein in its entirety and for all purposes.

BACKGROUND OF THE INVENTION

1. Field of Invention

The present disclosure relates to an electrical submersible pump ("ESP") having an internal lubricant pump for distributing lubricant in a single direction within the ESP irrespective of directional rotation of the pump.

2. Description of Prior Art

One type of pump assembly used particularly in oil producing wells has a submersible pump and electrical motor filled with a dielectric motor lubricant, which is typically referred to as an electrical submersible pump ("ESP"). The motor rotates a shaft assembly to drive the pump. A seal section connects between the motor and the pump. The seal section has a shaft seal to seal well fluid from contaminating the motor lubricant.

Most ESPs include internal pumping means for distributing the dielectric fluid lubricant within the ESP and that operate from shaft rotation. The direction that the dielectric motor lubricant flows from the internal pumping means is generally based on rotational direction of the shaft assembly, and the dielectric motor lubricant will undergo a backflow if the shaft assembly reverses its rotational direction. A lubricant backflow can flush debris from filters in the ESP and carry the debris to a thrust bearing on the shaft assembly, which can have damaging effects on the thrust bearing surface.

SUMMARY OF THE INVENTION

Disclosed is an example of an electrical submersible pump assembly ("ESP") that includes a motor, a pump connected to the motor by a shaft, a seal section, and a lubricant pump. The lubricant pump is made up of a diffuser having an axial bore with sidewalls that are oriented generally oblique to an axis of the shaft and that define a flow section within the diffuser, and an impeller having a portion with an outer surface profiled complementary to the flow section and that is disposed within the flow section, so that when the impeller is rotated in any direction and with respect to the diffuser, lubricant flow is induced along the flow section in a direction away from an apex of the impeller. A pumping section is defined by the outer surface of the portion of the impeller. In an example, the pumping section is frusto-conically shaped. Elongated ribs are optionally included on the pumping section that extend along a line that intersects an axis of the shaft, wherein slots are formed between adjacent ribs. In an embodiment, a taper of the pumping section varies with a taper of the flow section, and alternatively one or more of the width, length, and height of the ribs varies. Elongated ribs can be on the sidewalls of the diffuser. The impeller can be mounted to the shaft. In one example the ESP includes a thrust bearing assembly that is coupled to the shaft and in the path of the lubricant flow. The impeller outer surface is optionally dimpled with indentations, bumps, or protrusions. The lubricant pump can be formed using an additive manufacturing process. Materials for the lubricant pump include plastic injection materials, PTFE, and molecularly imprinted polymer, metal (machine, cast, or otherwise), plastic, and combinations. Optionally, the lubricant pump is assembled in the seal as a separate insert and the stationary insert is combined with the bearing retainer. In one example, the insert and bearing retainer are monolithic.

Another example of an electrical submersible pump assembly ("ESP") is disclosed that includes a motor, a pump connected to the motor by a shaft, a seal section, and a lubricant pump. The lubricant pump of this example includes an amount of fluid lubricant, a diffuser having an axial bore, and an impeller disposed in the bore, the diffuser and impeller configured to rotate relative to one another in a clockwise direction and in a counterclockwise direction, and when rotating to induce a flow of the lubricant in an axial direction when rotation is clockwise, and in the same axial direction when rotation is counterclockwise. In an embodiment, the bore and an outer surface of the impeller are frusto-conically shaped and complementary to one another. Ribs are optinally disposed on an outer surface of the impeller. The impeller includes an upstream portion, a mid-portion, and a downstream portion that are axially adjacent one another, and where a port is formed radially through the upstream portion through which lubricant flow is induced by relative rotation of the impeller and diffuser.

BRIEF DESCRIPTION OF DRAWINGS

Some of the features and benefits of the present invention having been stated, others will become apparent as the description proceeds when taken in conjunction with the accompanying drawings, in which.

Figure 2A:
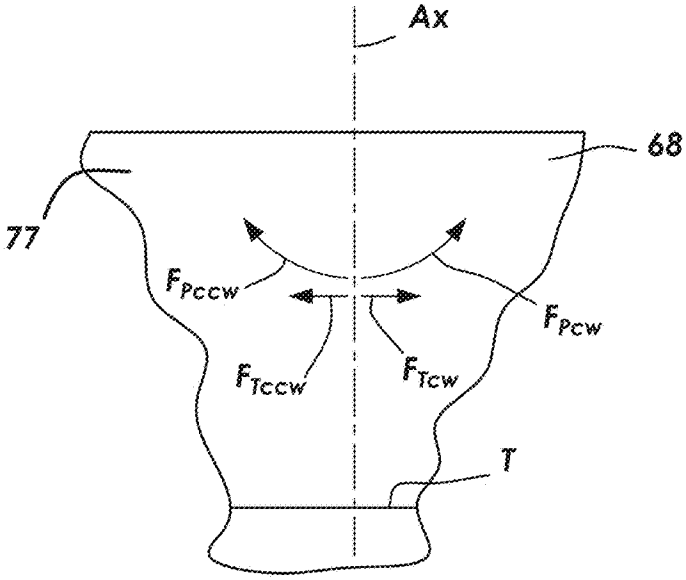
FIG. 2A is a schematic example of fluid flow within the lubricant pump of FIG. 2.

While subject matter is described in connection with embodiments disclosed herein, it will be understood that the scope of the present disclosure is not limited to any particular embodiment. On the contrary, it is intended to cover all alternatives, modifications, and equivalents thereof.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1:
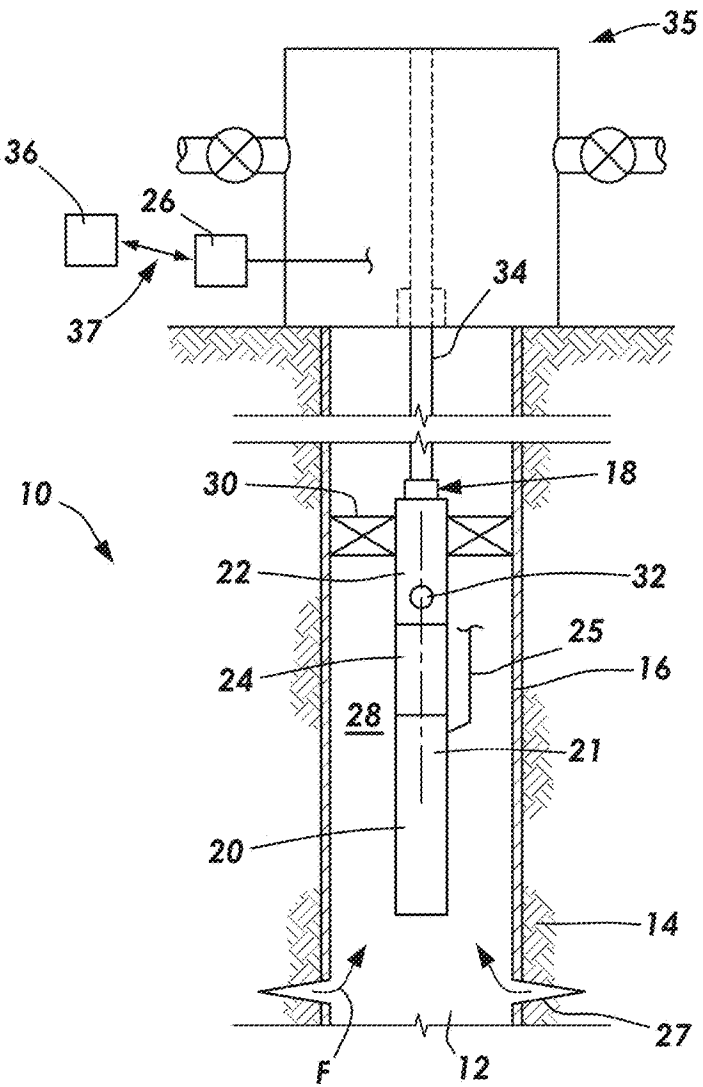
FIG. 1 is a side partial sectional view of an example of an ESP deployed in a wellbore.

An example of a wellbore system 10 is shown in a side sectional view in FIG. 1 in which a wellbore 12 is formed into a subterranean formation 14. Casing 16 lines the wellbore 12, inserted into wellbore 12 is an ESP assembly 18 for producing fluid F from inside the wellbore 12. The fluid F flows into the wellbore 12 from the formation 14. Included with ESP assembly 18 is a motor 20, a shaft 21 (shown in dashed outline), pump 22, and seal section 24 between the motor 20 and pump 22. Shaft 21 extends axially through the seal section 24, and has opposing ends attached to the motor 20 and to the pump 22. Energizing motor 20 with electricity rotates shaft 21 to provide mechanical energy to pump 22 for pressurizing fluid F. Electricity is provided to the motor 20 via power cord 25 shown having an opposite end connected to a power source 26 on surface. Perforations 27 are shown projecting radially outward from wellbore 12, through casing 16, and a distance into formation 14; perforations 27 provide a conduit for fluid F to flow into wellbore 12 from formation 14. After entering wellbore 12, pressure from formation 14 urges fluid F upward into an annulus 28 between ESP assembly 18 and casing 16. In the example of FIG. 1 packers 30 are installed in annulus 28 for redirecting the fluid F into an inlet 32 shown formed on pump 22. Inside pump 22 fluid F is pressurized and then discharged into production tubing 34 shown attached to an end of ESP assembly 18 proximate pump 22. An end of production tubing 34 distal from ESP assembly 18 connects to a wellhead assembly 35 on surface, which receives the pressurized fluid from the tubing 34 and redirects it into a production line for transmission to an off-site location for storage and/or processing. An optional controller 36 is shown on surface for providing command and/or control signals for operation of the wellbore system 10. Controller 36 optionally includes an information handling system ("IHS"). In embodiments, the IHS includes a processor, memory accessible by the processor, nonvolatile storage area accessible by the processor, and logics for performing steps described herein. Communication between controller 36 and power source 26 is optionally provided by communication means 37, which in examples include one or more of conductive elements, fiberoptics, and wireless.

Figure 2:
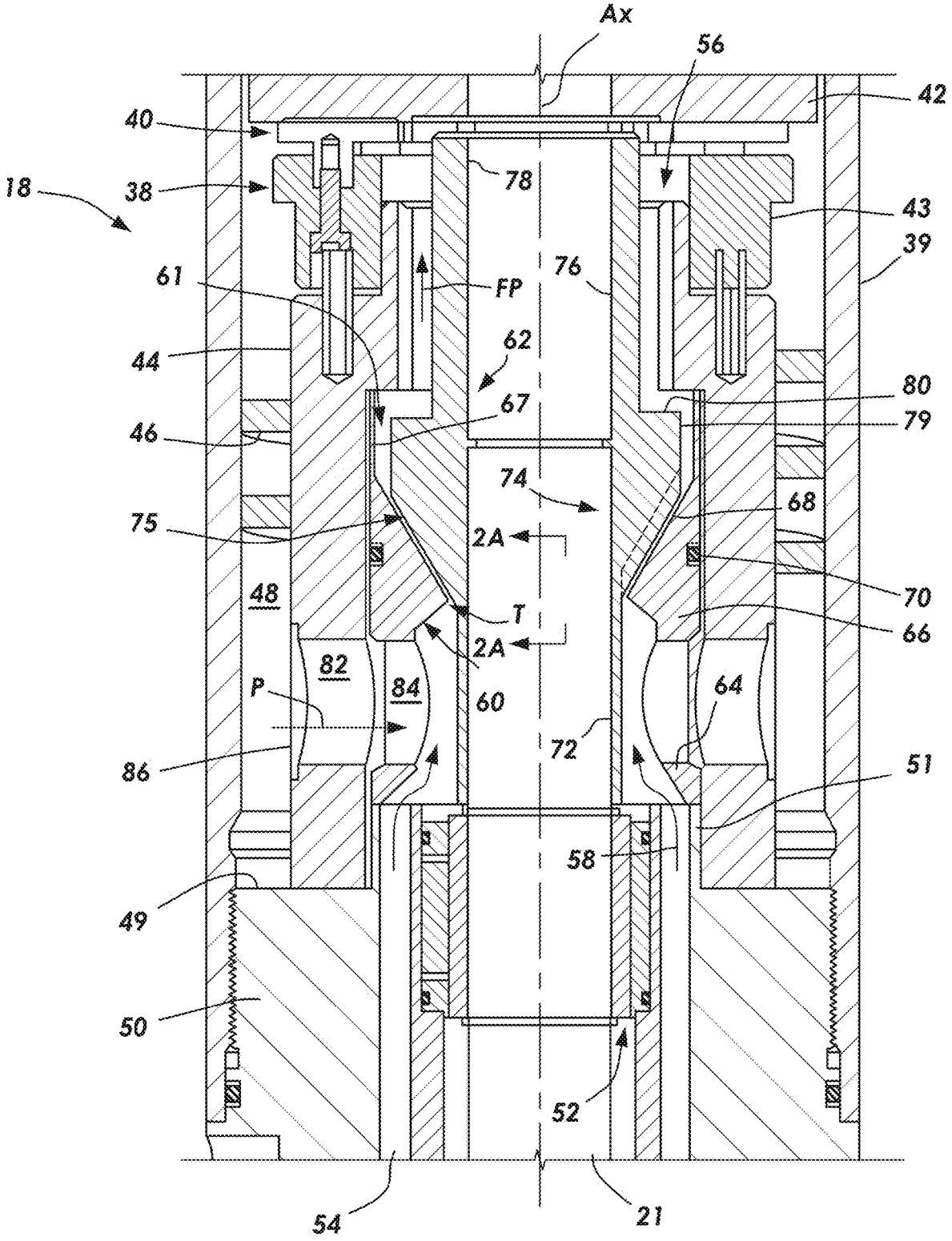
FIG. 2 is a side sectional view of an example of the ESP of FIG. 1 having a lubricant pump.

FIG. 2 is a side sectional view of a portion of ESP assembly 18 in seal section 24, which includes a thrust bearing assembly 38 for countering axial forces exerted onto shaft 21 in response to rotating impellers (not shown) located in pump 22 (FIG. 1) that are coupled with shaft 21. In the example of FIG. 2, a housing 39 is shown that provides a protective covering for the components within seal section 24. Thrust bearing assembly 38 includes thrust pads 40 shown abutting a downhole-facing surface of a thrust runner 42 that couples to shaft 21. In the example shown, thrust pads 40 are supported on a bearing body 43, which is a ring-like member that circumscribes shaft 21. The thrust pads 40 are spaced angularly apart from one another on the bearing body 43, and their surfaces that face thrust runner 42 are generally planar. Bearing body 43 is on a side of pads 40 opposite runner 42 and is supported on a bearing retainer 44, which is a generally annular member and centered within housing 39 by ring-like supports 46 that span within an annular space 48 between bearing retainer 44 and an inner surface of housing 39. An end of bearing retainer 44 opposite from bearing body 43 rests onto a shoulder 49 of an annular base 50 shown within housing 39 and circumscribing shaft 21. Radially inward from shoulder 49 is an annular lip 51 that is on an end of base 50 facing thrust bearing 38, lip 51 is defined by a reduced outer diameter of base 50 and is shown circumscribed by the end of bearing retainer 44 resting on shoulder 49. Between base 50 and shaft 21 is a bearing assembly 52 that is made up of opposing inner and outer races of journal bearings that attach between the shaft 21 and inner surface of base 50. A passage 54 extends axially within base 50 and spaced radially outward from and proximate to bearing assembly 52.

A bore 56 is formed axially within the bearing retainer 44 and in which shaft 21 is disposed. In the annular space between shaft 21 and sidewalls of bore 56 is a lubricant pump 58. Included in lubricant pump 58 is an annular diffuser 60 having an outer surface that is in close contact with an inner surface of bore 56. An axial bore 61 extends through diffuser 60 and that receives an impeller 62 shown mounted on shaft 21, impeller 62 rotates with and in the same direction as the rotation of shaft 21. Impeller 60 has an upstream portion 64, a mid-portion 66, and a downstream portion 67. Upstream portion 64 is shown supported on a free end of lip 51 opposite from shoulder 49. The upstream portion 64 radius is greater along its mid-section, and reduced at its opposing ends. Mid portion 66 is adjacent an end of upstream portion 64 distal from lip 51. In the example of FIG. 2, an outer diameter of mid portion 66 is substantially constant along axis $A_X$, whereas its inner diameter decreases with distance away from upstream portion 64 up to a transition point T, where the inner diameter abruptly increases to form a frusto-conical surface shown facing towards thrust bearing assembly 38. A flow section 68 is formed along the inner surface of mid portion 66 between the transition T and a downstream portion 67 of diffuser 60. Downstream portion 67 has a sleeve-like cross-section and is defined where an inner diameter of diffuser 60 remains substantially constant along axis $A_X$. An O-ring 70 is shown circumscribing an outer surface of mid portion 66 to form a barrier to fluid flow between the diffuser 60 and bearing retainer 44.

Still referring to FIG. 2, impeller 62 is made up of an upstream section 72, a pumping section 74, and a downstream section 76. Upstream section 72 is the portion of impeller 62 adjacent the bearing assembly 52 and shown circumscribed by upstream portion 64 of diffuser 60. An inner diameter of impeller 62 is substantially constant along axis $A_X$, and the portion of impeller 62 where upstream section 72 is located has an outer diameter that is also constant along axis $A_X$ to give upstream section 72 a generally annular cross section. Upstream portion 72 transitions into pumping portion 74 proximate where an outer diameter of impeller 62 increases linearly with distance from upstream portion 72. Example embodiments include the surface of pumping portion 74 being dimpled with indentations 77, variations in surface roughness along surface of pumping portion 74, and combinations of both. As shown in FIG. 2, the outer diameter of pumping portion 74 increases with axial distances to form a frusto-conical surface that in examples is substantially complementary to the frusto-conical surface formed in the upper section 66. In alternatives, the adjacently facing surfaces of upper section 66 and pumping portion 74 diverge away from one another with distance from the upstream section 72, or optionally converge towards one another with distance from the upstream section 72. Downstream section 76 is shown on the side of pumping section 74 opposite upstream section 72, which is substantially annular and in the example shown having a wall thickness (i.e., outer diameter—inner diameter) greater than a wall thickness of upstream section 72. A bore 78 is axially formed in impeller 62 and in which shaft 21 is inserted. A key (not shown) or splines (not shown) are optionally used to couple impeller 62 with shaft 21. A portion of pumping section 74 axially past the frusto-conical surface and adjacent downstream section 76 has a substantially constant outer diameter to define an axial surface 79, which is shown spaced radially inward from downstream portion 67. The outer diameter of diffuser 62 transitions abruptly where the pumping section 74 and downstream section 76 join to form a shoulder 80 having a radial surface facing towards downstream section 76.

Further shown in FIG. 2 is a port 82 formed radially through a sidewall of bearing retainer 44 adjacent to a port 84 formed through a sidewall of diffuser 60. Ports 82, 84 are shown in registration with one another and provide a path P for communication of lubricant and/or dielectric fluid ("LDF") within annulus 48 to an inlet of the lubricant pump 58. In alternatives, LDF or other fluid in passage 54 makes its way to an inlet of the lubricant pump 58. In a non-limiting example of operation, motor 20 (FIG. 1) is energized with electricity from power source 26 and rotates shaft 21 causing impeller 62 to rotate with respect to diffuser 60. Schematically represented in FIG. 2A are tangential forces $F_{Tccw}$, $F_{Tcw}$ resulting from rotation of impeller 62 in respective counterclockwise and clockwise directions. Paths $F_{Pccw}$, $F_{Pcw}$ represent the resulting respective flow paths of LDF (or other fluid) along flow surface 68 in response to counterclockwise and clockwise rotation of impeller 62. More specifically, rotating impeller 62 in a counterclockwise direction exerts force $F_{Tccw}$ onto LDF that is in contact with the outer diameter of impeller 62, and rotating impeller 62 in a clockwise direction exerts force $F_{Tcw}$ onto LDF that is in contact with the outer diameter of impeller 62. Forces $F_{Tccw}$, $F_{Tcw}$ are tangential to axis $A_X$, and urge LDF circumferentially along flow surface 68, which has an increasing radius with distance from transition T. Not to be bound by theory, it is believed that due to inertia of the flowing LDF, the contour of flow surface 68 redirects the LDF along path $F_{Pccw}$ or path $F_{Pcw}$ (depending on the rotational direction of impeller 62) to areas of the flow surface 68 having increased diameter and away from transition T. In the example of FIG. 2A, paths $F_{Pccw}$, $F_{Pcw}$ are each generally helical and circumscribe axis $A_X$. Referring back to FIG. 2, continued rotation of impeller 62 further creates a flow of lubricant between the diffuser 60 and impeller 62 to urge LDF along path $F_P$, which is shown extending through an annular space between downstream section 76 and bearing retainer 44, so that the LDF flows towards the thrust-bearing assembly 38. An advantage of the frusto-conically-shaped complimentary surfaces of the diffuser 60 and impeller 62 is that irrespective of the rotation of shaft, i.e., clockwise or counterclockwise, the LDF flows towards the increasing radius portion of diffuser 60. The unidirectional flow of LDF along flow surface 68 results in the LDF flowing in a single direction through the screen 86 and ports 82, 84 and towards the thrust bearing assembly 38; and which prevents the situation in which any debris trapped on an outer surface of screen 86 on an outer radial portion of port 82 to backflush up to thrust bearing assembly 38.

Figure 3:
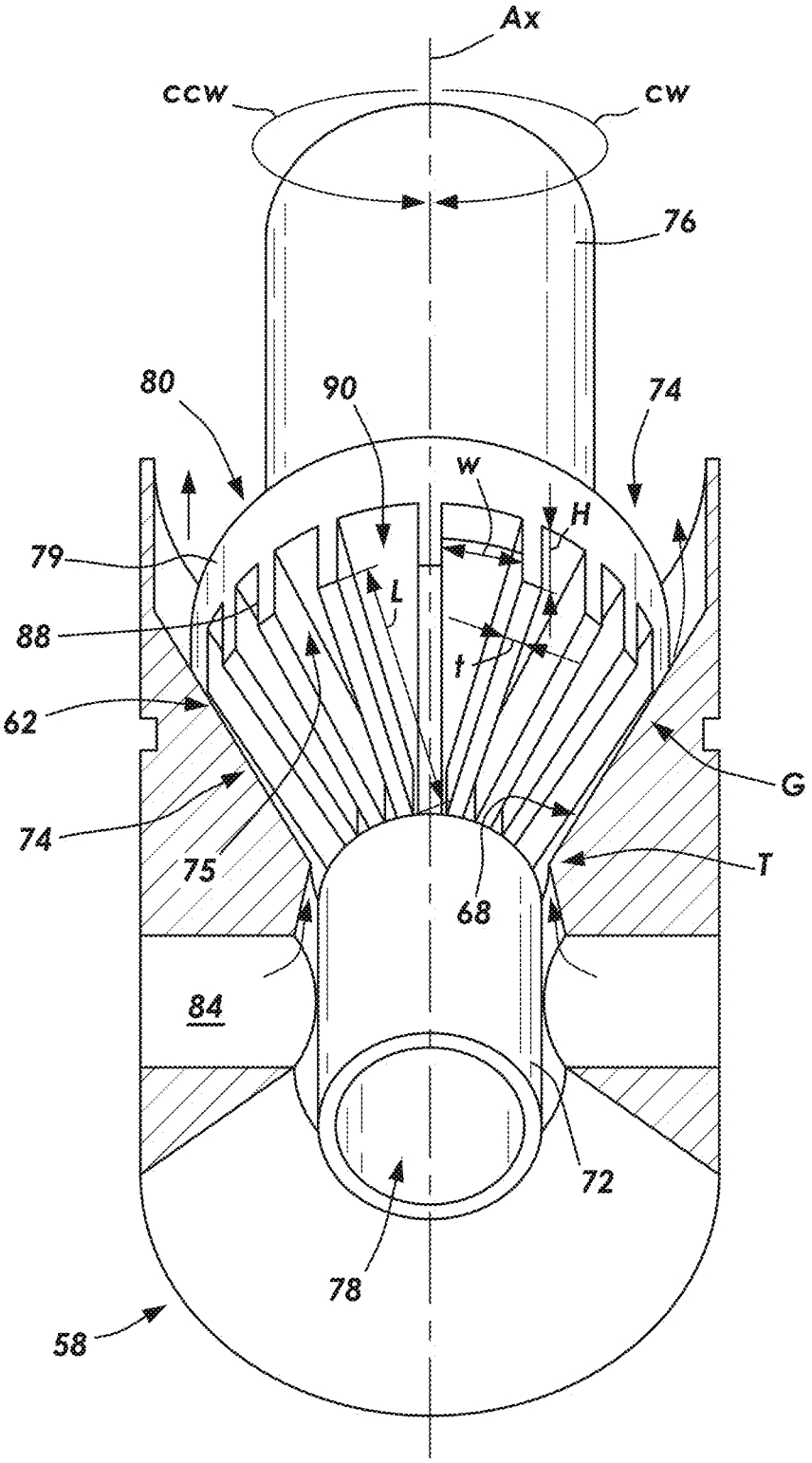
FIG. 3 is a side partial sectional view of an example diffuser and impeller of the lubricant pump of FIG. 2.

Referring now to FIG. 3, shown in a side partial perspective view is an example of the lubricant pump 58 and in which the surface 75 of the pumping portion 74 is equipped with elongated ribs 88 that extend from the axial surface 79 and upstream section 72. Ribs 88 of FIG. 3 have a generally rectangular cross-section, a length L, and a thickness t that is shown constant along length L. In alternatives thickness t varies. Formed between ribs 88 are slots 90 that each have a width W; in examples, a width W of one or more of the slots 90 increases with distance away from upstream section 72. A height H of ribs 88 is defined by a distance between the surface 75 and outer radial surface of ribs 88; in examples values of the height H remains constant along a length L of ribs 88, and in alternatives values of the height H vary along length L of ribs 88. A gap G is shown which represents a space between the outer surfaces of ribs 88 and flow surface 68. Dimensions and tolerances for determining magnitude of gap G is within the capabilities of one skilled in the art. Further shown in FIG. 3 are the opposing rotational directions of clockwise (CW) and counterclockwise (CCW) rotation about axis 21, which in either rotational direction of impeller 62 will create a flow of LDF along the frusto-conical flow surface 68 along a helical path away from inlet port 84 and upstream section 72 and towards the downstream section 76. Embodiments exist in which ribs and slots (not shown) are provided on flow surface 68 of diffuser 62, alternatives exist in which these ribs and slots have the same or different quantity, dimensions, and/or configuration of ribs 88 and slots 90.

Advantages of the ESP assembly 18 (FIG. 1) disclosed herein are not limited to the ability of the single directional flow but also greater cooling and also an increased power output. In a computational fluid dynamics simulation lubricant being pumped with the lubricant pump 58 experienced a 9° Fahrenheit reduction in temperature over that of other known lubricant pump systems. And while heat flux in portions of the pump was unaffected with the improved lubricant pump 58, values of power output were seen to be 15% higher with the embodiment of the lubricant pump disclosed herein over that of known lubricant pumping systems.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, manufacturing options exist for diffuser 60 and rotor 62 and other components of lubricant pump 58, such as being formed using additive manufacturing, from materials including plastic injection materials, e.g., polytetrafluoroethylene ("PTFE") as sold under the trade name Rulon® and molecularly imprinted polymer, metal (machine, cast, or otherwise), plastic, and combinations thereof. Optionally, the lubricant pump 58 is disposed inside motor 20 or another part of the ESP assembly 18 (FIG. 1). Further options include assembling the pump in the seal as a separate insert, combining the stationary insert with the bearing retainer, and the insert and bearing retainer being one piece. These and other similar modifications will readily suggest themselves to those skilled in the art, and are intended to be encompassed within the spirit of the present invention disclosed herein and the scope of the appended claims.

What is claimed is:

1. An electrical submersible pump assembly ("ESP") comprising:
   a motor;
   a pump connected to the motor by a shaft;
   a seal section; and
   a lubricant pump comprising,
      a diffuser having an axial bore with sidewalls that are oriented generally oblique to an axis of the shaft and that define a frusto-conical flow section within the diffuser, and
      an impeller having an axis and a portion with a frusto-conically shaped outer surface that is disposed within the flow section, so that when the impeller is rotated about the axis and with respect to the diffuser, a lubricant flow is induced along the flow section.

2. The ESP of claim 1, wherein the outer surface of the portion of the impeller defines a pumping section.

3. The ESP of claim 2, wherein the diffuser comprises an upstream portion, a mid-portion, and a downstream portion that are axially adjacent one another, and wherein a port is formed radially through the upstream portion through which lubricant flow is induced by relative rotation of the impeller and diffuser.

4. The ESP of claim 2, further comprising elongated ribs on the pumping section that extend along a line that intersects an axis of the shaft, wherein slots are formed between adjacent ribs.

5. The ESP of claim 2, wherein a taper of the pumping section varies with a taper of the flow section.

6. The ESP of claim 4, wherein one or more of a width, a length, and a height of the ribs varies.

7. The ESP of claim 1, further comprising elongated ribs formed on the sidewalls of the diffuser.

8. The ESP of claim 1, wherein the impeller is mounted to the shaft.

9. The ESP of claim 1, further comprising a thrust bearing assembly that is coupled to the shaft and in the path of the lubricant flow.

10. The ESP of claim 1, wherein the impeller outer surface is dimpled with indentations.

11. The ESP of claim 1, wherein the lubricant pump is formed using an additive manufacturing process.

12. The ESP of claim 11, wherein the lubricant pump comprises materials selected from the group consisting of plastic injection materials, PTFE, and molecularly imprinted polymer, metal, plastic, and combinations thereof.

13. The ESP of claim 11, wherein the lubricant pump is assembled in the seal section as a separate insert and a stationary insert is combined with a bearing retainer.

14. The ESP of claim 13, wherein the stationary insert and bearing retainer are monolithic.

15. An electrical submersible pump assembly ("ESP") comprising:
   a motor;
   a pump connected to the motor by a shaft;
   a seal section; and
   a lubricant pump comprising,
      an amount of fluid lubricant,
      a diffuser having an axial bore, and
      an impeller disposed in the bore, the diffuser and impeller configured to rotate relative to one another in a clockwise direction and in a counterclockwise direction, and when rotating to induce a flow of the lubricant in an axial direction when rotation is clockwise, and in the same axial direction when rotation is counterclockwise.

16. The ESP of claim 15, wherein the bore and an outer surface of the impeller are frusto-conically shaped.

17. The ESP of claim 15, further comprising ribs on an outer surface of the impeller.

18. The ESP of claim 15, wherein the diffuser comprises an upstream portion, a mid-portion, and a downstream portion that are axially adjacent one another, and wherein a port is formed radially through the upstream portion through which lubricant flow is induced by relative rotation of the impeller and diffuser.

* * * * *